US011073010B2

(12) United States Patent
Knight

(10) Patent No.: US 11,073,010 B2
(45) Date of Patent: Jul. 27, 2021

(54) DOWNHOLE VALVE ASSEMBLY

(71) Applicant: Weatherford Technology Holdings, LLC, Houston, TX (US)

(72) Inventor: Matthew David Knight, Aberdeenshire (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/607,041

(22) PCT Filed: Apr. 19, 2018

(86) PCT No.: PCT/GB2018/051039

§ 371 (c)(1),
(2) Date: Oct. 21, 2019

(87) PCT Pub. No.: WO2018/193265

PCT Pub. Date: Oct. 25, 2018

(65) Prior Publication Data

US 2020/0048986 A1 Feb. 13, 2020

(30) Foreign Application Priority Data

Apr. 21, 2017 (GB) ..... 1706348

(51) Int. Cl.
*E21B 47/09* (2012.01)
*E21B 34/06* (2006.01)
(Continued)

(52) U.S. Cl.
CPC ..... *E21B 47/09* (2013.01); *E21B 34/06* (2013.01); *E21B 47/092* (2020.05); *E21B 43/12* (2013.01);
(Continued)

(58) Field of Classification Search
CPC ..... E21B 47/09; E21B 34/06; E21B 47/092; E21B 2200/06; E21B 47/0228; E21B 43/12
See application file for complete search history.

(56) References Cited

U.S. PATENT DOCUMENTS 5,475,302 A 12/1995 Mehnert et al.
6,995,352 B2 * 2/2006 Hay ..... G01D 5/35303 250/227.14
(Continued)

FOREIGN PATENT DOCUMENTS

EP 0628127 B1 10/1997
EP 1998002 A2 12/2008
(Continued)

OTHER PUBLICATIONS

International Search Report and the Written Opinion for International Application No. PCT/GB2018/051039 dated Jul. 20, 2018, 20 pages.

*Primary Examiner* — Nicole Coy
(74) *Attorney, Agent, or Firm* — Patterson + Sheridan, LLP

(57) ABSTRACT

A downhole valve assembly comprises a sleeve concentric with a housing and movable relative to a port through the housing to control flow of fluid through the port. A sensor assembly provides indicates the relative positions of the sleeve and housing, and comprises first and second sensors on e.g. the housing which detect markers on e.g. the sleeve. The sensor outputs are produced by processing (e.g. combining, integrating, summing, subtracting or otherwise processing) the signal components of each of the first and second sensors to correct for misalignment of the sleeve with the housing. The sensor output provides position information for more than one plane, and the output signal
(Continued)

therefore allows for correction of errors in the position information arising from misalignment of the sleeve with the housing.

27 Claims, 5 Drawing Sheets

(51) Int. Cl.

| | |
|---|---|
| ***E21B 43/12*** | (2006.01) |
| ***E21B 47/0228*** | (2012.01) |
| ***E21B 47/092*** | (2012.01) |
| *F15B 15/28* | (2006.01) |

(52) U.S. Cl.
CPC ..... *E21B 47/0228* (2020.05); *E21B 2200/06* (2020.05); *F15B 15/2807* (2013.01)

(56) References Cited

U.S. PATENT DOCUMENTS

| | | | | |
|---|---|---|---|---|
| 7,000,698 | B2 * | 2/2006 | Mayeu | E21B 47/135 166/255.1 |
| 7,195,033 | B2 * | 3/2007 | Mayeu | G01B 11/002 137/554 |
| 7,810,564 | B2 * | 10/2010 | Montgomery | E21B 47/09 166/255.1 |
| 8,836,325 | B2 * | 9/2014 | Prost | G01D 5/04 324/207.21 |
| 9,267,819 | B2 | 2/2016 | Cook | |
| 9,797,238 | B2 * | 10/2017 | Frosell | G01V 3/081 |
| 2003/0127232 | A1 * | 7/2003 | Bussear | E21B 47/135 166/373 |
| 2004/0035578 | A1 | 2/2004 | Ross et al. | |
| 2004/0135075 | A1 | 7/2004 | Hay et al. | |
| 2004/0163809 | A1 | 8/2004 | Mayeu et al. | |
| 2004/0194958 | A1 | 10/2004 | Mayeu et al. | |
| 2009/0128141 | A1 * | 5/2009 | Hopmann | E21B 47/092 324/207.24 |

FOREIGN PATENT DOCUMENTS

| | | | |
|---|---|---|---|
| EP | 2103908 | A1 | 9/2009 |
| EP | 2778339 | A1 | 9/2014 |
| GB | 2397080 | A | 7/2004 |
| GB | 2531782 | A | 5/2016 |
| WO | 2003042498 | A1 | 5/2003 |
| WO | 2006120466 | A2 | 11/2006 |
| WO | 2014132078 | A2 | 9/2014 |
| WO | 2014184587 | A2 | 11/2014 |
| WO | 2014195733 | A2 | 12/2014 |

* cited by examiner

DOWNHOLE VALVE ASSEMBLY

The present application relates to a downhole valve assembly, and particularly to a downhole sliding sleeve-type valve assembly for use in an oil or gas well, having a position sensor for sensing the position of a movable part of the valve assembly relative to a static part of the valve assembly.

Sliding sleeve valves are well known in the production of hydrocarbons from underground wells, both onshore and offshore. Sliding sleeve valves typically have an outer housing that is incorporated within the production tubing of a well. The housing has flow ports to permit wellbore production fluids from a reservoir to enter the production tubing. The ports in the housing permitting the inflow of production fluids are opened and closed by sleeves which slide relative to the port in the housing, to align flow ports in the sleeve with the flow ports in the housing when the valve is open, and to move them out of alignment when the valve disclosed.

In many applications it is desirable to determine the relative positions of the sleeve and the housing, for example, to check whether the valve is open or closed. EP1998002, EP2103908, EP2778339, WO2006/120466, WO2014/132078 and US2004/0163809 disclose earlier designs of sliding sleeve which are useful for understanding the invention, and which are incorporated herein by reference.

SUMMARY

According to the present invention there is provided a downhole valve assembly having a housing with an axis and a sleeve concentric with the housing and that is movable relative to a flowpath through the housing to vary flow of fluid through the flowpath in different relative positions of the housing and the sleeve, wherein the valve assembly incorporates a sensor assembly providing an output signal indicating the position of the sleeve relative to the housing, wherein the sensor assembly comprises first and second primary sensors disposed on one of the housing and the sleeve adapted to detect markers on the other of the housing and the sleeve, wherein the first and second primary sensors are disposed in different circumferential positions around the axis, and wherein the output signal is produced by processing the signal components of each of the first and second primary sensors.

Producing an output signal by processing (e.g. combining, integrating, summing, subtracting or otherwise processing) signal components from each of the circumferentially spaced first and second primary sensors allows the output signal of the sensor assembly to provide position information for more than one plane, and the output signal therefore allows for correction of errors in the position information, for example, arising from misalignment of the sleeve with the housing.

Optionally the first and second primary sensors comprise inductive proximity sensors. Optionally the first and second primary sensors sense the distance between the housing and the sleeve. Optionally the distance between the housing and the sleeve varies at the marker. Optionally the first and second primary sensors are on the housing and the marker is on the sleeve, but this could be reversed. Optionally the first and second primary sensors are axially aligned, in other words they are at the same axial position on the housing (or the sleeve) but are circumferentially spaced from one another at that axial position. Optionally the first and second primary sensors are diagonally opposite, but other circumferential spacing is also useful. Optionally the first and second primary sensors are regularly spaced, with equal circumferential distances between adjacent primary sensors, but in some examples, this is not necessary.

The sensors optionally do not require magnets which require the surrounding metalwork to be non-ferrous, and which themselves attract ferrous debris. Inductive proximity sensors are useful as they are largely unaffected by immersion in gas or liquid media, and will work consistently through brine, fresh water, oil, mud, hydrocarbon gas and air. Any differences due to fluid between the coil and target can be corrected for by the optional reference sensor. Optionally the sensors do not require contact with the target, nor electrical continuity between sensor and target. The sensors are optionally also solid-state, without requiring moving parts. Optionally, the target does not need to be made of, nor mount, anything special (like magnets, RFID tags, gamma sources). Optionally, it is sufficient for the target to be electrically conductive, and most metals can be formed into targets.

Optionally the marker is a geometric marker providing a variation in shape that can be detected by the sensor assembly. Optionally, the marker presents the same geometry to each of the first and second primary sensors. In some examples, the marker can be symmetrical about the axis. Optionally when the sleeve is aligned with the housing, the distance between the sleeve and the housing is uniform around their circumference, and the output signals from the first and second primary sensors will be substantially uniform. When the sleeve is misaligned with the housing, the distance between the primary sensors and the marker will not be uniform at the different circumferential positions of the primary sensors, and hence the output signals from the first and second primary sensors will be substantially non-uniform, or at least distinguishable from the substantially uniform signals than would be obtained if the housing and sleeve were aligned on the same axis. Processing the signals from the first and second primary sensors into the output signal reduces errors arising from misalignment of the sleeve and the housing, and deviations of each of them from the axis, e.g. bending, out of round tubes etc. Markers with symmetry around the axis are useful as they reduce or avoid the introduction of errors in the output signal arising from rotational misalignment of the markers with the sensors.

Optionally the first and second primary sensors can be single sensors, or can be a plurality of sensors arranged in an array. The array can optionally be parallel to the axis, or circumferentially around the axis.

Optionally the sleeve is received in an axial bore of the housing. Optionally the sleeve could be outside the housing. Optionally the housing, bore and the sleeve are all generally tubular, and have end terminations such as box and pin connections which are adapted to be connected into a tubing string, for example a length of production tubing in the oil or gas well.

Optionally each of the first and second primary sensors comprise a sensor coil having an induction loop having of one or more loops of a conductive element forming an electrical circuit through which electrical current is flowing. Electrical current flowing through the sensor coils is optionally driven by a printed circuit board assembly (PCBA) comprising one or more of a coil driver, an inductance measuring device, an amplifier circuit, a microprocessor control unit, a modem device adapted to transmit the signal back to the surface, and a power conditioning unit. A suitable inductance measuring device could comprise an inductance to digital converter such as the Texas Instrument product LDC1000 disclosed at http://www.ti.com/product/ldc1000, which is incorporated herein by reference. The sensor coil optionally comprises an insulated, electrically conducting loop typically installed in a static position, for example in the wall of the housing. The PCBA optionally drives AC current through the loops at suitable frequencies, for example, between 5 kHz and 5 MHz, and optionally generates a magnetic field around the primary sensor. Higher frequency gives better resolution and sample rate. The actual frequency of the sensor can optionally vary with distance to the target, as the inductance value varies. Current is optionally driven continuously through the coils during sensing. When ferrous targets enter the field generated by the sensor coil, eddy currents are typically generated in the surface of the target within the field of the primary sensor. The eddy currents in the target then typically generate their own magnetic field which can oppose and interfere with the magnetic field generated by the sensor coil, causing it to collapse and resulting in a change in the signal which is reflected in the output signals from each of the discrete sensor coils. The change in the signal is typically dependent on the distance between the sensor coil, and the geometry and material of the target marker in the field of the sensor coil. Hence, the change in the signals emitted by the discrete sensor coils typically provides an indication of the separation between the individual coils and the target, as in many examples, the material and geometry of the target markers can be consistent and only the distance separating the coils and the target will be variable depending on alignment of the sleeve and the housing. Hence, if variation of the output signal from the sensor coil is higher on one side of the sleeve than on the other, the signal provides an indication of misalignment, and optionally self-trims for signal differences arising from misalignment rather than differences in axial position. Optionally the signals from the individual primary sensors can be processed in the electronics pack, optionally by summing them or subtracting them or otherwise integrating them to reduce errors. For example, in summing two signals from diametrically opposed primary sensors, any lack of alignment between the sleeve and the housing is automatically corrected in the integrated signal.

The inductive sensor coil optionally behaves as a tuned electrical circuit sensing structures adjacent to the coil, particularly conductive structures, such as ferrous metal objects, and is able to report distance between the sensor coil and the adjacent detected object. When the sleeve moves over the loop in each sensor coil that is disposed static in the housing wall, the output from each sensor coil to the electronics pack on the PCBA typically varies with the distance separating the sensor coil and the part of the sliding sleeve adjacent to the coil, and optionally with the material from which that adjacent portion of the sliding sleeve is made. Either the distance or the material can be varied in order to provide markers on the sleeve (or the housing) that are detectable by the sensor coil at particular positions along the axis of the sleeve and housing. Variations in depth or material as the markers move into the field typically induce eddy currents in the markers as indicated above, which typically generates an opposing magnetic field resulting in a decrease of the inductance in the sensor coil. The decreased inductance in the sensor coil is detectable in the MCU, which typically sends a signal via the modem to a controller (for example on the surface of the well) signifying the presence of the marker in the observed range of the sensor coil. The inductance variation in the sensor coil can be calibrated for particular markers on the movable part of the sliding sleeve valve, and so can distinguish between different markers on the same sliding sleeve.

Optionally more than one marker is provided. Different markers optionally elicit different signals from the primary sensors, so that the different markers can be distinguished. The markers can optionally be spaced along the axis, optionally by a known distance. Optionally relative axial movement between the sleeve and the housing can be tracked, and the position of the sleeve relative to the housing can be determined based on the output signal.

Optionally the assembly has at least one reference sensor, and optionally first and second reference sensors, which are optionally circumferentially spaced around the axis in the same manner as the first and second primary sensors. Optionally the reference sensors provide a signal indicating the distance between the sleeve and the housing at an un-marked portion of the assembly when the primary sensors detect a marker. Optionally the signal(s) from the reference sensor(s) are processed along with the signals from the primary sensors to provide a reference signal reflecting a baseline signal in the absence of a marker, for comparison with the signal from the primary sensors detecting the marker. This further allows trimming of errors by emphasising differences between the signals generated by the primary sensors detecting the markers and artefact signals generated by misalignment, out of round tubular sections, bending and other factors likely to affect errors inherent in the signal.

Optionally the signal from the reference sensor(s) is compared with the signal from the primary sensors to determine the relative position of the sleeve with respect to the housing.

The invention also provides a method of determining the state of a downhole valve assembly, wherein the downhole valve assembly comprises: a housing with an axis and a sleeve concentric with the housing wherein the sleeve is movable relative to a flowpath through the housing to vary flow of fluid through the flowpath in different relative positions of the housing and the sleeve, a primary sensor assembly comprising first and second primary sensors disposed on one of the housing and the sleeve adapted to detect markers on the other of the housing and the sleeve, wherein the first and second primary sensors are disposed at different circumferential positions around the axis, wherein the method includes detecting a marker with each of the first and second primary sensors, and producing an output signal by processing signal components of each of the first and second primary sensors, for example, to correct for misalignment of the sleeve with the housing.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features, and advantages of the present invention are readily apparent from the entire description thereof, including the figures, which illustrates a number of exemplary aspects and implementations. The invention is also capable of other and different examples and aspects, and its several details can be modified in various respects, all without departing from the spirit and scope of the present invention. Accordingly, each example herein should be understood to have broad application, and is meant to illustrate one possible way of carrying out the invention, without intending to suggest that the scope of this disclosure, including the claims, is limited to that example. Furthermore, the terminology and phraseology used herein is solely used for descriptive purposes and should not be construed as limiting in scope. In particular, unless otherwise stated, dimensions and numerical values included herein are presented as examples illustrating one possible aspect of the claimed subject matter, without limiting the disclosure to the particular dimensions or values recited. All numerical values in this disclosure are understood as being modified by "about". All singular forms of elements, or any other components described herein are understood to include plural forms thereof and vice versa.

Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

References to directional and positional descriptions such as upper and lower and directions e.g. "up", "down" etc. are to be interpreted by a skilled reader in the context of the examples described to refer to the orientation of features shown in the drawings, and are not to be interpreted as limiting the invention to the literal interpretation of the term, but instead should be as understood by the skilled addressee. In particular, positional references in relation to the well such as "up" and similar terms will be interpreted to refer to a direction toward the point of entry of the borehole into the ground or the seabed, and "down" and similar terms will be interpreted to refer to a direction away from the point of entry, whether the well being referred to is a conventional vertical well or a deviated well.

Figure 1:
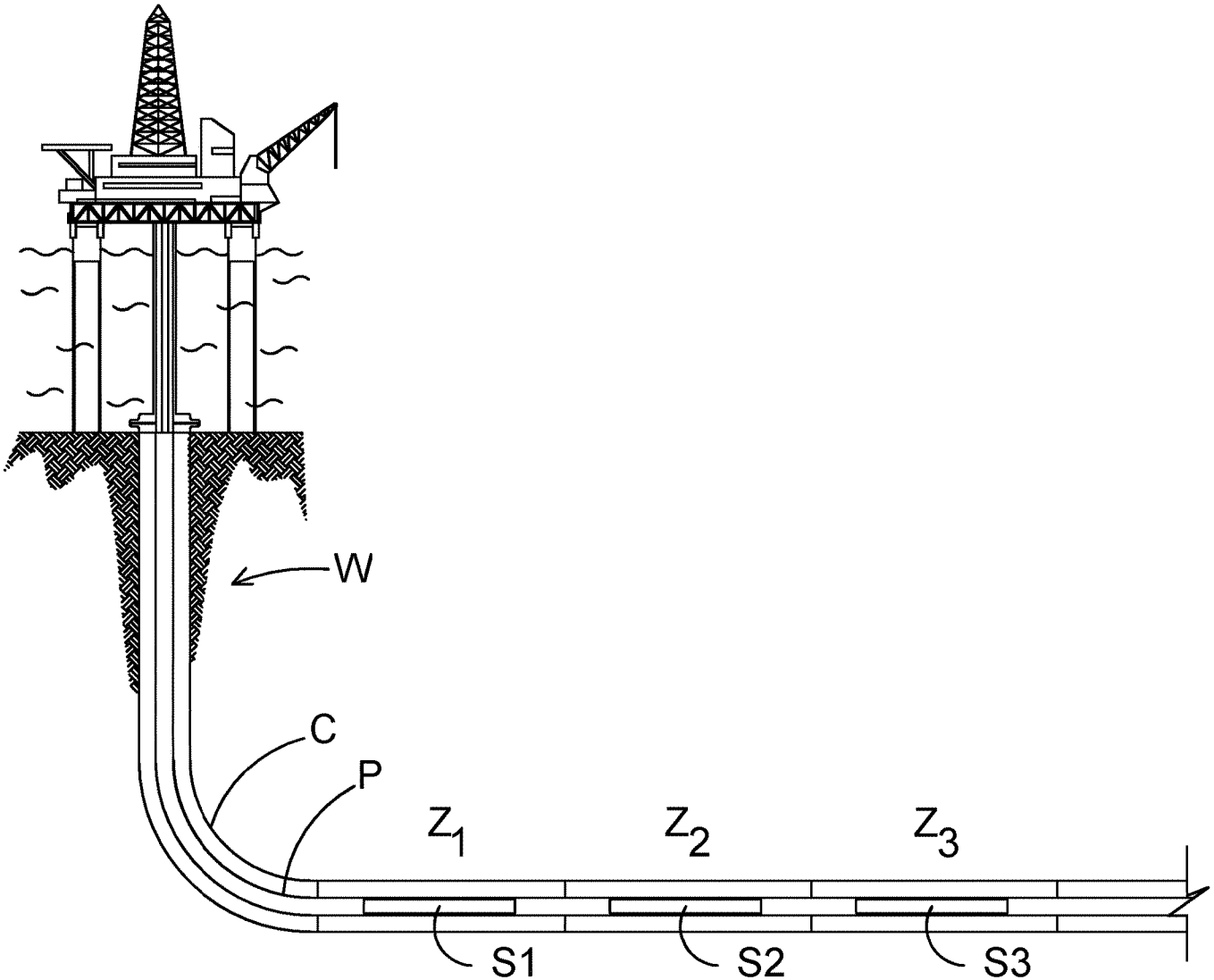
FIG. 1 shows a schematic view of an offshore oil or gas well.

Referring now to the drawings, after a well W has been drilled and cased with casing C, it is conventional to "complete" the well by installing conduits, valves and other mechanisms to assist and control the flow of production fluids from different zones of the reservoir into the well W, and to recover the production fluids from the well to the surface. In the example shown in FIG. 1, the well W is an offshore well (although examples can equally be applied to onshore wells) and the production fluids are being recovered through tubing such as production tubing P which connects the different zones Z1, Z2, Z3 with a wellhead and production platform at the surface of the well. The annulus between the production tubing P and casing C is obturated by barrier devices such as packers located inside the casing and outside the production tubing at the boundaries between the different zones Z1, Z2, Z3, and each corresponding zone of the casing has a respective set of perforations to allow production fluids from each discreet zone to flow into the corresponding section of the casing. The casing C in each zone has a separate inflow control valve in the form of a downhole valve assembly S1, S2, S3 in accordance with the invention. Thus, by opening one of the valves S1, S2, S3, to a greater or lesser extent, production fluids can be produced from one zone but not others. The figures shown are schematic and not to scale.

The downhole valve assemblies S1, S2, S3 are installed in this example at the time of completion, shortly after drilling the well W, and are operated by respective control lines from the surface in order to open and close them during the life of the well W. Each downhole valve assembly S1, S2, S3 can be opened, partially opened or closed in order to control the inflow of production fluids from each zone Z1, Z2, Z3 depending on the signals carried by the control lines.

Figure 2:
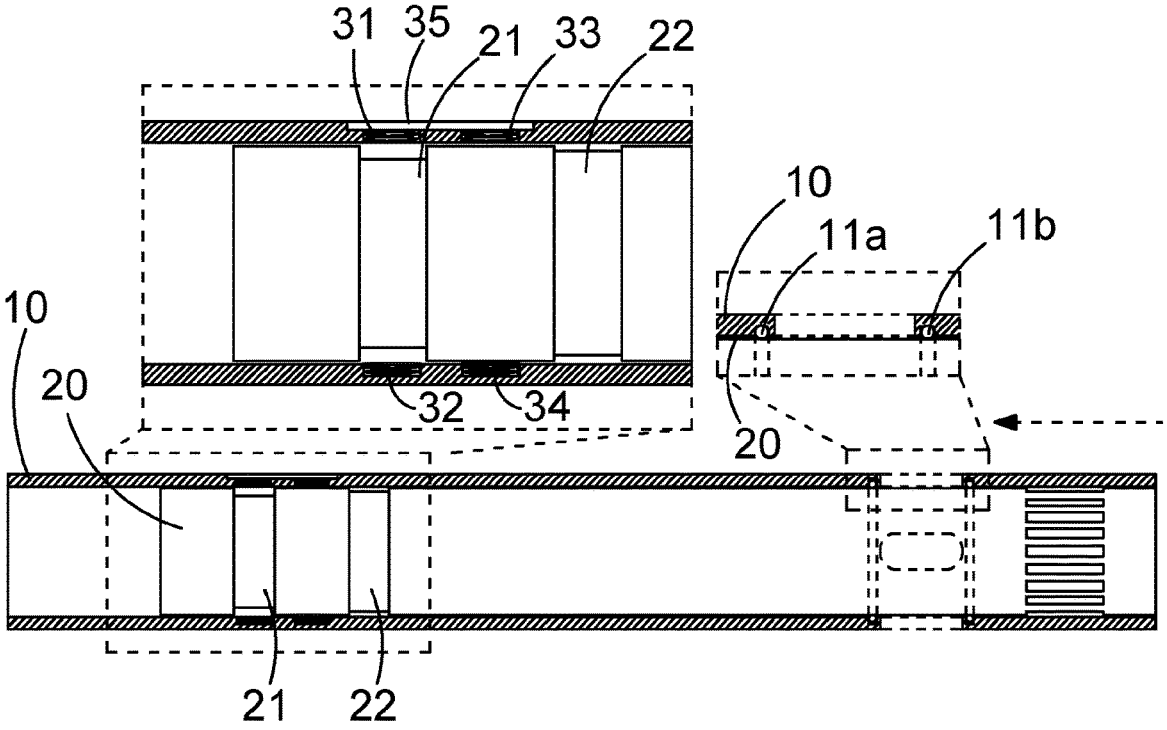
FIGS. 2 and 3 show schematic side views in section of a downhole valve assembly used in the FIG. 1 well in a closed and open configuration.
Figure 3:
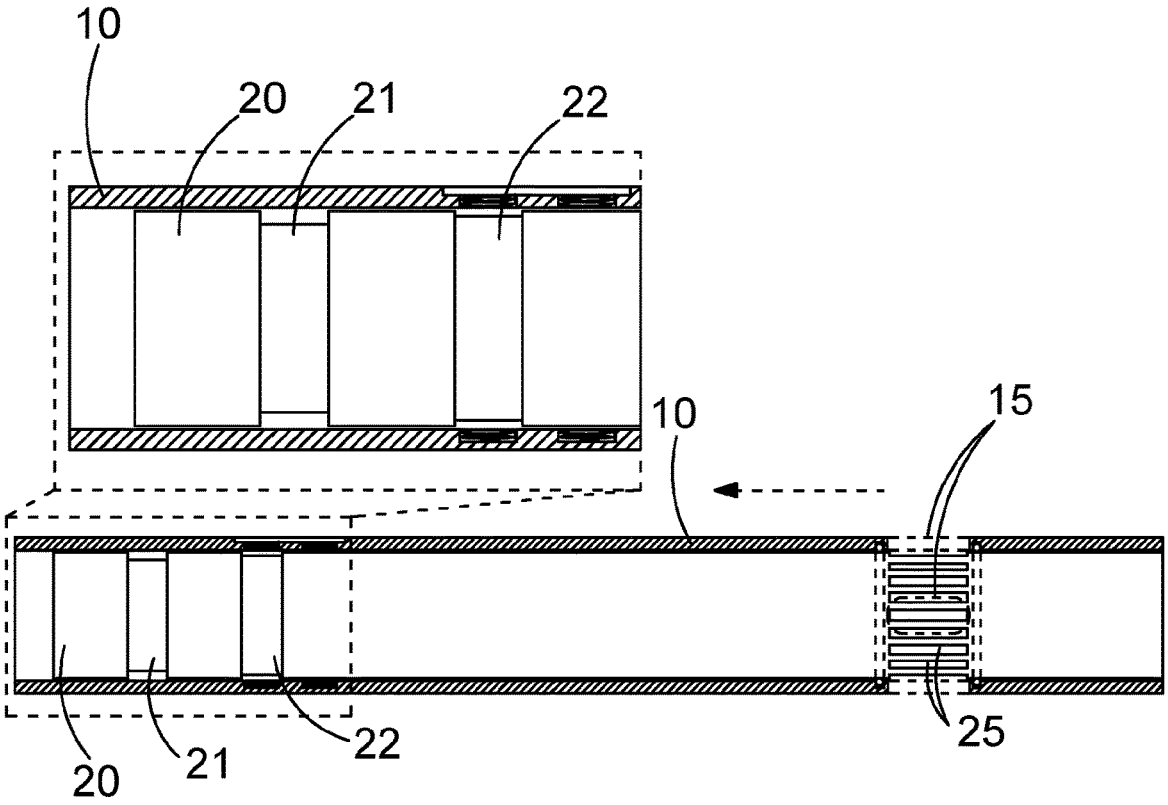
Figure 4:
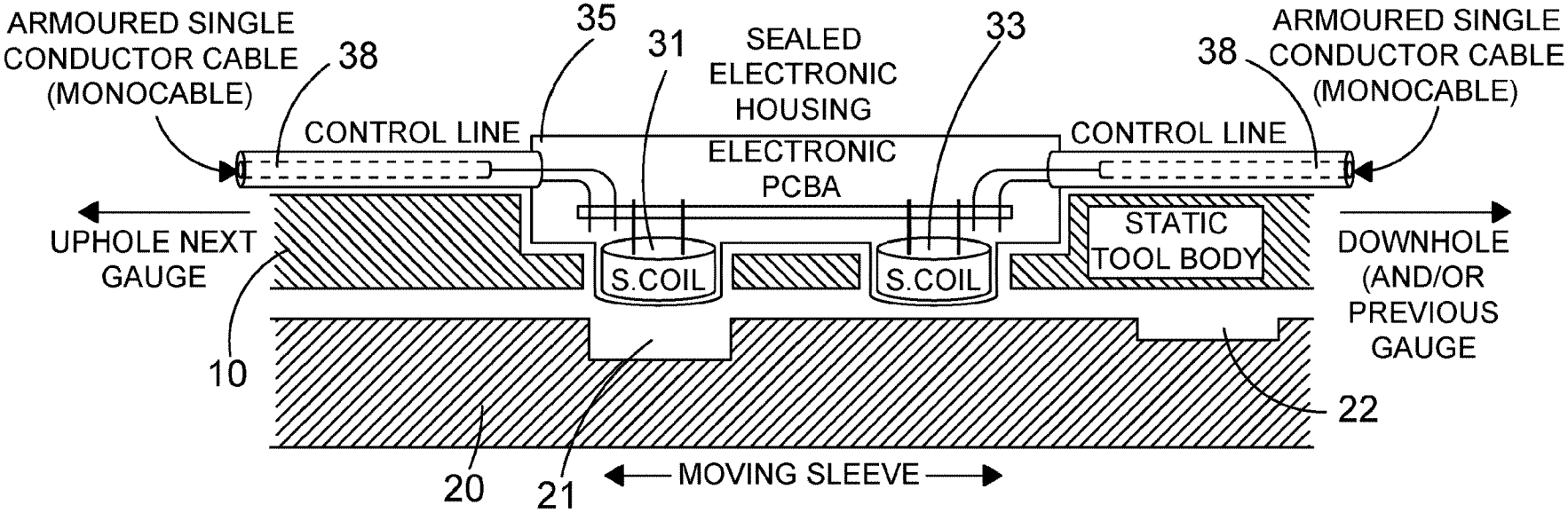
FIG. 4 shows a close up of a first primary sensor of the FIGS. 2 and 3 downhole valve assembly.
Figure 5:
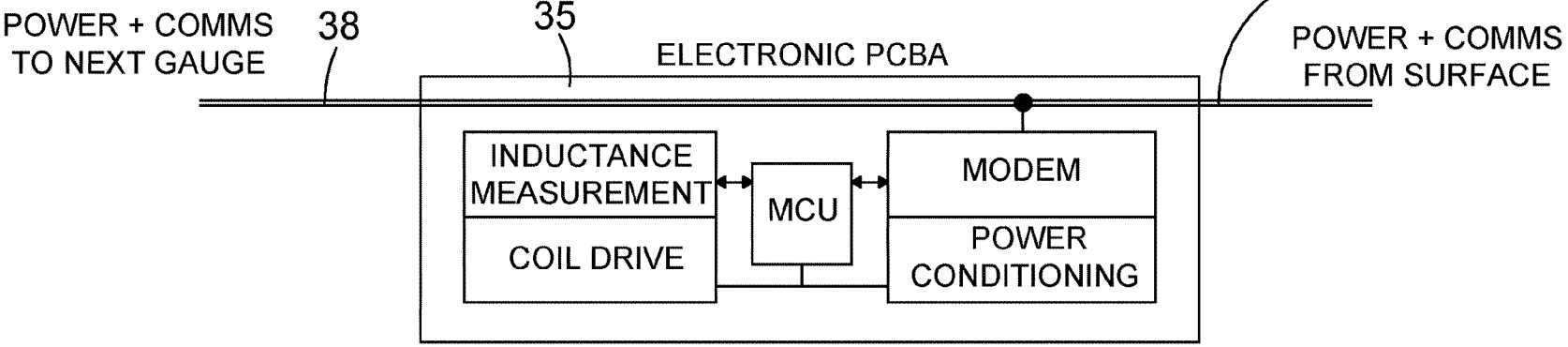
FIG. 5 shows a schematic view of an electronics pack of the FIGS. 2 and 3 downhole valve assembly.

Turning now to FIGS. 2 and 3, a sliding sleeve valve is shown in closed and open configurations respectively. In the present example shown in FIG. 1, the sliding sleeve valves S1, S2, S3 are substantially identical and will not be described separately, although, of course, it is possible for different configurations of valves to be included within the completion. The sliding sleeve downhole valve assembly of FIG. 1 has a housing 10 having uphole and downhole ends provided with suitable connectors, such as box and pin connectors, known to the skilled person, for connecting the assembly in line with a conduit such as the production tubing P. The housing 10 has a bore having an axis X allowing flow of fluid between the downhole and uphole ends of the housing 10. The housing 10 also has fluid inlets in the form of apertures 15 passing radially through the wall of the housing 10 close to its downhole end. Optionally more than one aperture 15 is provided, and in such cases, the plurality of apertures 15 are optionally arranged at the same axial location on the housing 10, but are optionally circumferentially spaced around the axis X. As can be seen in FIG. 2, four apertures are provided in this example, arranged as diagonally opposite pairs spaced around the circumference of the housing 10. The apertures 15 allow inflow of production fluids from zone Z1 into the bore of the casing C and thus into the conduit of the production tubing P for recovery from the well W. The apertures 15 are opened and closed by a sliding sleeve 20, which slides axially along the axis X between the closed configuration shown in FIG. 2 and the open configuration shown in FIG. 3. It is of course possible that the sleeve 20 is moved to intermediate relative positions between fully open and fully closed positions to partially choke the flow. The sleeve 20 opens and closes the apertures 15 by sliding axially to move a set of apertures 25 at the downhole end of the sleeve 20 passing through the wall of the sleeve 20 in and out of axial alignment with the apertures 15 in the downhole end of the housing 10. Circumferential seals 11 are set in recesses on the inner surface of the housing 10 above and below the apertures 15, and are radially compressed between the outer surface of the sleeve 20 and the inner surface of the housing 10, thereby sealing the annulus between the sleeve 20 and the housing 10. When the sleeve 20 is in its closed position, the apertures 25 are axially spaced below both of the seals 11, and are not in axial alignment with the apertures 15; therefore while production fluids can flow through the apertures 15, they are prevented from further ingress into the bore of the housing 10 by the seals 11 and the unapertured section of the sleeve 20, thereby closing the valve.

When the sleeve 20 has slid axially upwards to the open configuration shown in FIG. 3, the apertures 25 on the sleeve 20 are located between the seals 11, in register with the apertures 15 through the wall of the housing 10 and axially aligned with them, thereby allowing fluid communication between the apertures 15 in the housing and apertures 25 in the sleeve 20. This permits free flow of fluid from the reservoir zone outside the casing through perforations in the casing and into the bore of the housing. The amount of flow permitted is dependent on the area of overlap between the apertures 25 and the apertures 15, and in some configurations, the apertures 25 can only be partially aligned with the apertures 15, thereby choking the flow to different extents depending on the control signals provided to the valve actuator.

The sleeve 20 has a number of markers near its uphole end, which in this case are geometric markers in the form of grooves 21, 22 which are axially spaced from one another along the sleeve 20 and which are both axially spaced from the apertures 25 at the downhole end of the sleeve 20 as can be seen in FIGS. 2 and 3. The grooves 21, 22 are optionally annular, extending around the full circumference of the generally tubular sleeve 20, and in this case the grooves 21, 22 have a consistent geometry around the circumference, i.e. the depth of each groove 21, 22 is consistent around the circumference of the sleeve 20. However, groove 22 is shallower than groove 21. The grooves 21, 22 are mutually parallel, and are perpendicular to the axis X and are axially spaced apart from one another.

As the sleeve 20 slides axially within the bore of the housing 10, the grooves 21, 22 move axially relative to first and second primary sensors 31, 32 disposed on the inner wall of the housing 10 within diagonally opposite recesses. The first and second primary sensors 31, 32 are substantially identical in this case, and each one optionally comprises a sensor coil forming an inductive proximity primary sensor. Each of the first and second primary sensors is controlled from an electronics pack 35 comprising a printed circuit board assembly having an inductance measurement chip optionally in the form of Texas instruments component LDC1000, although other inductance measurement devices can optionally be used. Optionally, the electronics pack comprises at least one or more of any of a coil driver to energise the sensor coil of the first and second primary sensors 31, 32, a microcontroller unit, a modem device for transmission of signals from the primary sensors, and a power conditioning component. Power is supplied to the electronics pack through a control line 38 extending from the surface, optionally along the outer surface of the production tubing, and interfacing with the PCBA in the electronics pack 35. Optionally, the same electronics pack 35 powers and controls each of the first and second primary sensors 31, 32 for each valve assembly, but optionally each primary sensor 31, 32 can have its own individual electronics pack 35. Optionally, the sliding sleeve devices S1, S2, S3 are connected in series by the control line 38, which is optionally an armoured single conductor cable that provides power and signals from the surface platform.

The primary sensors 31, 32 in this example are disposed in axial alignment with one another, in other words, they are situated at the same axial location along the axis X of the housing 10, close to the uphole end of the housing 10. The primary sensors 31, 32 face one another in diagonally opposite positions in this example, although in other examples, primary sensors can be arranged in two sets of opposing pairs, or in a set of three or some other arrangement of primary sensors circumferentially separated around the axis of the housing 10. While the primary sensor is 31, 32 in this example are in disclosed as being located at the same axial position, in some other examples, they could be axially spaced.

The housing 10 also has a pair of reference sensors 33, 34 disposed in recesses on the inner surface of the housing. The reference sensors are constructed and arranged in the same manner as the primary sensors 31, 32, except that the reference sensors 33, 34 are axially spaced downhole from the primary sensors 31, 32 (i.e. between the primary sensors 31, 32 and the downhole end of the housing 10) by a distance that is shorter than the distance between the grooves 21, 22. In this example, the reference sensors 33, 34 are spaced downhole from the primary sensors 31, 32 by about half of the inter-groove distance, so that when the primary sensors 31, 32 are lined up with the first groove 21, the reference sensors 33, 34 are disposed between the grooves 21, 22, e.g. roughly half way between them.

When the sleeve 20 slides axially upwards towards the uphole end to the configuration shown in FIG. 2, such that the apertures 25 in the sleeve 20 approach the lower seal 11*b*, the deeper first groove 21 on the moving sleeve 20 approaches the axial position of the first and second primary sensors 31, 32, and at a point before the apertures 25 reach the lower seal 11*b*, while the apertures 15 are still closed, the groove 21 lines up with the primary sensors 31, 32, adopting the configuration as shown in FIG. 2. At this point, the reference sensors 33, 34 are about half way between the grooves 21, 22, lined up with an unmarked section of the outer surface of the sleeve 20 in between the grooves 21, 22 which has a consistent diameter.

Figure 6:
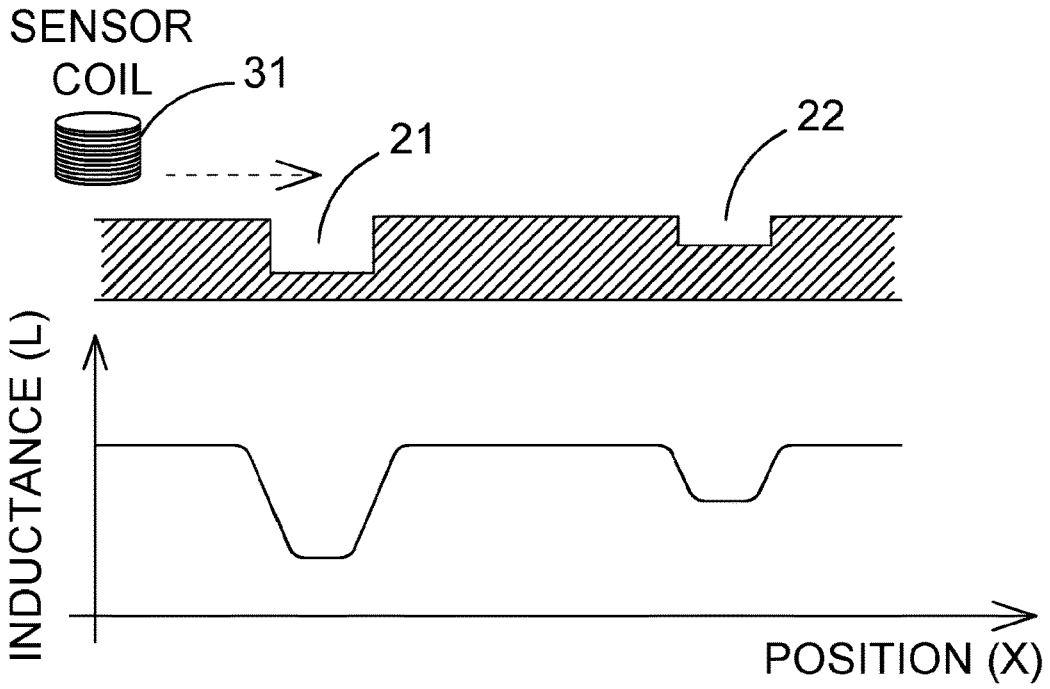
FIG. 6 shows a schematic graph showing a combined output signal from the primary sensors of FIG. 4 in different relative positions of the sleeve relative to a housing of the FIGS. 2 and 3 downhole valve assembly.

FIG. 6 shows a graph of relative position of the sleeve 20 with respect to the housing 10 on the x-axis and integrated inductance reported by the first and second primary sensors 31, 32 on the y-axis. The relative positions of the primary sensors 31, 32 and the grooves 21, 22 are also superimposed on the graph, showing the changes in the readings from the primary sensors as the different grooves move in and out of alignment with the primary sensors. The inductance reported by all the sensors 31-34 varies directly with the distance between the sensors disposed at the inner surface of the wall of the housing 10 and the sleeve 20. Since the primary sensors 31, 32 are at circumferentially spaced positions around the axis X, the inductance reading from the different primary sensors 31,32 therefore report the distance between the housing 10 and the sleeve 20 in different circumferentially spaced positions. These two values reported independently by the individual sensors 31, 32 are integrated in the electronics pack 35, for example, by summing the two individual readings together before reporting the combined signal as the output to the communication line 38. The integration of the two signals from the primary sensors 31, 32 cancels or at least reduces errors arising from misalignment of the housing and the sleeve, since if the groove is too close to the sensor 31, it is likely to be too far away from the sensor 32 by the same amount. Thus the integration of the signal from the first and second primary sensors 31, 32 allows correction for errors and optionally allows reporting of the extent to which the sleeve and housing are aligned.

The signals from the reference sensors 33, 34 generally track the signals of the primary sensors 31, 32, except that they lag behind them in terms of the position (x) because of the axial separation between the primary sensors 31, 32, and the reference sensors 33, 34. Thus when the primary sensors 31, 32 are lined up with the first groove 21, the reference sensors 33, 34 are lined up with the unmarked inter-groove section, which results in the same relatively high and constant baseline signal from the reference sensors 33, 34 shown at the starting position on FIG. 6.

Before the sleeve 20 reaches the configuration shown in FIG. 2, with the primary sensors axially aligned with a portion of the sleeve 20 above the groove 21 and before the groove 21 moves into alignment with the primary sensors 31, 32, the observed inductance from the sensor coil on each of the primary sensors 31, 32 is at a relatively high baseline level which remains relatively static during the axial translation of the sleeve 20 in this un-grooved area of the housing 10, as shown in the first part of the graph in FIG. 6. As the groove 21 reaches the axial position on the housing 10 in alignment with the first and second primary sensors 31, 32 as shown in FIG. 2, the inductance observed by each primary sensor 31, 32 reduces at the same time and the integrated signal shows as a decrease in the induction as shown in FIG. 6. The reduction in inductance observed by each of the primary sensors 31, 32 is substantially identical if the sleeve and the housing are aligned, since in alignment, the primary sensors 31, 32 at diagonally opposite locations around the circumference of the housing 10 report the same separation between the housing 10 and the sleeve 20 at the groove 21. However, in the event of misalignment, the integrated signal as shown in FIG. 6 self corrects, because if the sleeve is too close to one of the sensors 31, 32, it will be too far from the other by the same amount. At the first reduction in inductance corresponding to the first groove 21, the operator can be confident that the signal seen in FIG. 6 is corrected for misalignment errors and the like, and the true position of the sleeve within the housing is correctly reported. The operator can also be confident that the reduction in the integrated signal is not due to loss of signal due to a primary sensor being out of range of the marker. In the electronics pack 35, the output signals from each of the primary sensors 31, 32 is analysed, comparing the two signals and providing information to the operator concerning the alignment of the sleeve 20 and the housing 10. In the event that the sleeve 20 and housing 10 are misaligned, inconsistencies between the signals of the two primary sensors 31, 32, are processed at the electronics pack to provide a warning to the operator.

When the primary sensors 31, 32 are axially aligned with the first groove 21, the reference sensors 33, 34 are positioned roughly half-way between the grooves 21, 22, and report the distance between the reference sensors 33, 34 and the un-marked outer surface of the sleeve 20 between the grooves 21, 22. In this position, the reference sensors 33, 34 report the same relatively high baseline inductance shown at the start of the graph of FIG. 6, as the distance between the reference sensors 33, 34 and the sleeve 20 is relatively small and consistent. The reference signal is processed by the electronics pack 35 to provide a baseline reading reflecting a lack of marker at the inter-groove surface for comparison with the reduction in inductance characterising the integrated signal from the primary sensors 31, 32, which further improves the error margin of the output signal.

As the sleeve 20 continues its axial movement upwards in the housing 10, the groove 21 moves out of alignment with the primary sensors 31, 32, and the un-grooved area between the grooves 21, 22 is aligned with the primary sensors 31, 32 until the second groove 22 comes into alignment with the primary sensors 31, 32, corresponding to the open configuration shown in FIG. 3. This series of changes is reported by the primary sensors 31, 32 as shown in FIG. 6. In the un-grooved transition zone between the two grooves 21, 22, the primary sensors 31, 32 both report the return to the same high baseline inductance between the two reductions appearing in FIG. 6, again corrected for errors in alignment. As the second shallower groove 22 lines up with the axial position of the primary sensors 31, 32, the reported inductance reduces, creating the second shallower dip shown in FIG. 6, confirming that the downhole valve assembly has reached the 100% open configuration shown in FIG. 3. Again, the output of each of the primary sensors 31, 32 is integrated to report a combined reading, and the consistent shallow dip confirms the fully open configuration shown in FIG. 3 corrected for alignment errors. The signals generated by the two grooves 21, 22 are distinguishable as shown in FIG. 6. While two markers in the form of the grooves 21, 22 are shown in the present example showing the 100% closed and 100% open configurations, other examples can optionally have intermediate grooves or other markers reporting intermediate positions between these two extremes, for example, 90%, 80%, 70%, 60%, 50%, 40%, 30%, 20% and 10% closed. The reference sensors 33, 34 will move over the grooves 21, 22 shortly before the primary sensors 31, 32 as they are axially closer to the grooves 21, 22 as a result of the axial separation between the primary and reference sensors, resulting in output signals from the reference sensors corresponding to reductions in the observed inductance as the reference sensors cross the grooves 21, 22 as described above in relation to the primary sensors 31, 32.

In this example, the axial width of the grooves 21, 22 is equal, and the grooves are geometrically different only in their radial depth, hence improving the sensitivity of the primary sensors to distinguish between the grooves 21, 22 and hence determine the axial position and alignment of the sleeve 20 relative to the housing 10.

Figure 9:
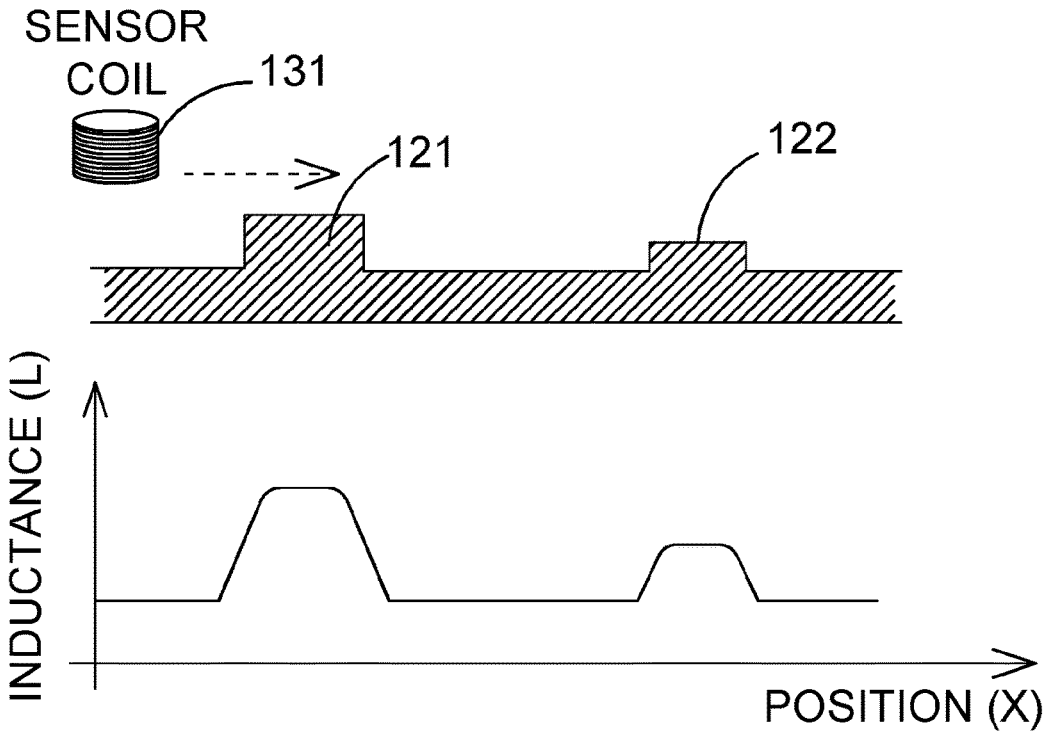
FIG. 9 shows a schematic graph showing a combined output signal from the primary sensors of the example in FIGS. 8 and 9 in different relative positions of the sleeve relative to a housing of the FIGS. 8 and 9 downhole valve assembly.
Figure 7:
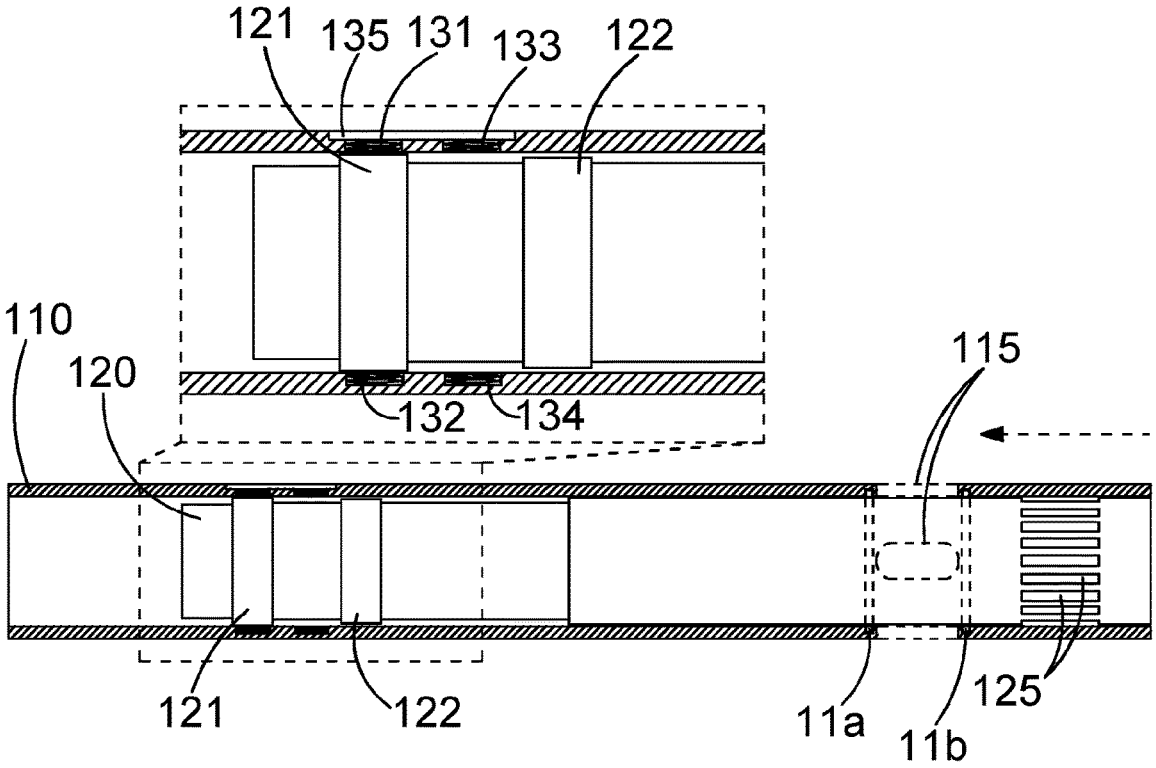
FIGS. 7 and 8 show an alternative example of a sleeve that is suitable for use in a downhole valve assembly used in the FIG. 1 well in a closed and open configuration.
Figure 8:
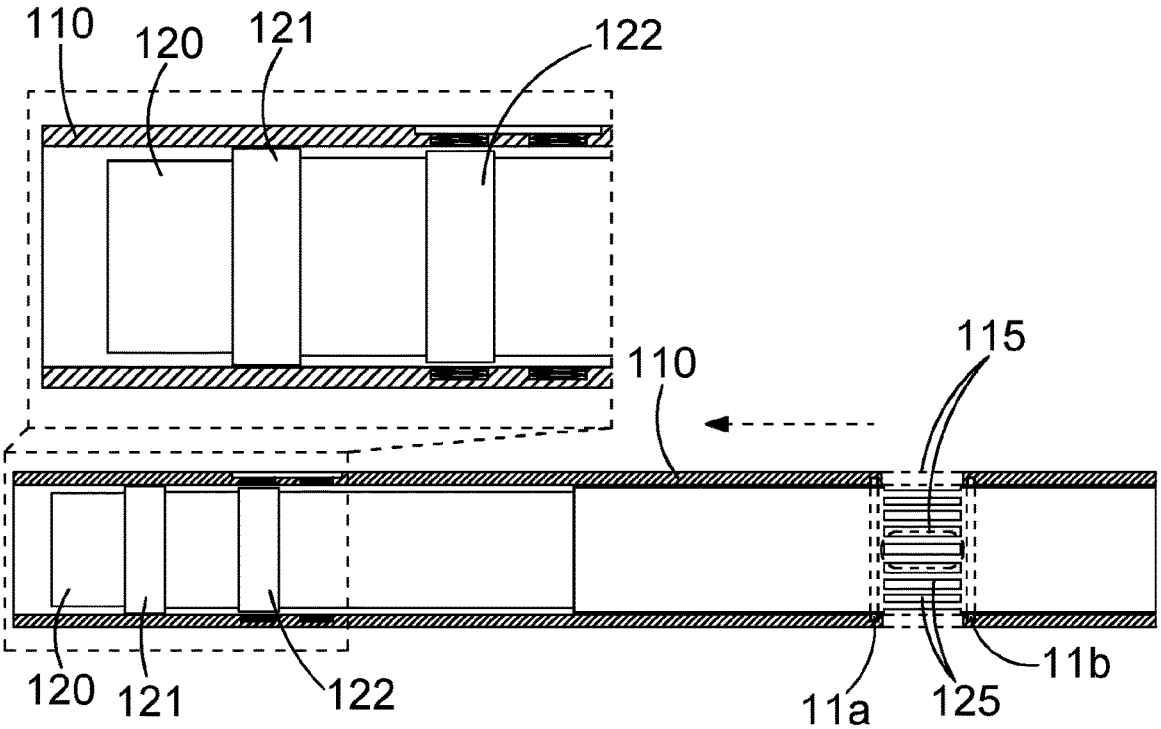

FIGS. 7 and 8 shows the arrangement of targets to be identified by the primary sensors in an alternative example of a downhole valve assembly. In this example, the details described above for the first example are the same, except that the targets are radial shoulders instead of grooves, and instead of dips in inductance, the observable variations in inductance are rises. In the FIG. 8 example, similar features in common with the first example described above will not be described in detail, but will be given the same reference number, increased by 100. The reader is referred to the above description for the common features. The sleeve 120 has first and second targets in the form of annular shoulders 121, 122, which interact with first and second primary sensors 131, 132 in the same way as described for the targets in the form of the grooves 21, 22 in the first example, subject to certain differences. In this example, the shoulders 121, 122 extend radially outward from the outer surface of the sleeve 120. They are parallel, and consistent in axial width as is described for the grooves 21, 22, but are distinguished by differences in radial extension away from the outer surface of the sleeve 120. It can be seen from FIGS. 7 and 8 that the upper shoulder 121 has a larger radial extension than the lower shoulder 122. With reference to FIG. 9, the shoulders 121, 122 elicit different variations in inductance from each of the primary sensors 131, 132 in the present example, which report on position and axial alignment of the sleeve 120 relative to the housing 110 in the same way as described for the first example, but instead of the measured inductance decreasing as it does when the primary sensors 31,32 line up with the grooves 21,22, in the present example, when the primary sensors 131,132 line up with the shoulders 121,122 the observed inductance reported by each of the primary sensors 131,132 increases rather than decreases. Like the first example, the second example can be provided with intermediate markers showing intermediate positions between the 100% open and 100% closed configurations, and can report on position and alignment of the sleeve 120 with the housing 110 in the same manner as previously described for the first example.

In certain examples, the assembly is capable of sensing of discrete positions and/or of continuous measurement of e.g. a track on the surface e.g. of the sleeve, which could optionally vary in returned signal strength in steps or in a continuous manner.

The invention claimed is:

1. A downhole valve assembly, comprising:

a housing with a longitudinal axis and a sleeve concentrically aligned with the housing and that is movable relative to a flowpath through the housing to vary flow of fluid through the flowpath in different relative positions of the housing and the sleeve, wherein the valve assembly incorporates a sensor assembly providing an output signal indicating the position of the sleeve relative to the housing, wherein the sensor assembly comprises:

first and second primary sensors disposed on one of the housing and the sleeve adapted to detect markers on the other of the housing and the sleeve, wherein the first and second primary sensors are disposed in different circumferential positions around the longitudinal axis, and wherein the output signal is produced by processing signal components of each of the first and second primary sensors to correct for concentric misalignment between the sleeve and the housing.

2. The downhole valve assembly of claim 1, wherein signal components of each of the first and second primary sensors are processed by one or more of combining, integrating, summing and subtracting said output signal components to produce the output signal.

3. The downhole valve assembly of claim 1, wherein the first and second primary sensors comprise inductive proximity sensors.

4. The downhole valve assembly of claim 1, wherein the first and second primary sensors sense the distance between the housing and the sleeve.

5. The downhole valve assembly of claim 1, wherein the distance between the housing and the sleeve varies at the markers.

6. The downhole valve assembly of claim 1, wherein the first and second primary sensors are aligned at the same position on the longitudinal axis.

7. The downhole valve assembly of claim 1, wherein the first and second primary sensors are regularly spaced around the longitudinal axis with equal circumferential spacing between the first and second primary sensors.

8. The downhole valve assembly of claim 1, wherein the first and second primary sensors are disposed at diagonally opposite positions with respect to the longitudinal axis.

9. The downhole valve assembly of claim 1, wherein the markers are geometric markers.

10. The downhole valve assembly of claim 1, wherein each marker presents the same geometry to each of the first and second primary sensors when equidistant from the first and second primary sensors.

11. The downhole valve assembly of claim 1, wherein each marker is symmetrical about the longitudinal axis.

12. The downhole valve assembly of claim 1, wherein the first primary sensor comprises a plurality of primary sensors arranged in an array of first primary sensors and wherein the second primary sensor comprises a plurality of primary sensors arranged in an array of second primary sensors.

13. The downhole valve assembly of claim 12, wherein each array of first and second primary sensors extends parallel to the longitudinal axis.

14. The downhole valve assembly of claim 12, wherein each array of first and second primary sensors extends at least partially around the circumference of the housing or the sleeve.

15. The downhole valve assembly of claim 1, including an electronics pack comprising at least one of a coil driver, an inductance measuring device, an amplifier circuit, a microprocessor control unit, a modem device adapted to transmit the output signal to a controller, and a power conditioning unit.

16. The downhole valve assembly of claim 1, including more than one marker distinguishable by the first and second primary sensors and spaced along the longitudinal axis by a known distance.

17. The downhole valve assembly of claim 1, wherein the assembly has at least one reference sensor.

18. The downhole valve assembly of claim 17, wherein the reference sensor(s) provide a signal indicating the distance between the sleeve and the housing at an un-marked portion of the assembly when the primary sensors detect a marker.

19. The downhole valve assembly of claim 17, wherein the signal(s) from the reference sensor(s) are processed along with the signals from the primary sensors to provide a reference signal reflecting a baseline signal in the absence of a marker.

20. The downhole valve assembly of claim 1, wherein the assembly has first and second reference sensors, circumferentially spaced around the longitudinal axis.

21. A method of determining the state of a downhole valve assembly, wherein the downhole valve assembly comprises:

a housing with a longitudinal axis and a sleeve concentrically aligned with the housing wherein the sleeve is movable relative to a flowpath through the housing to vary flow of fluid through the flowpath in different relative positions of the housing and the sleeve; and a primary sensor assembly comprising first and second primary sensors disposed on one of the housing and the sleeve adapted to detect markers on the other of the housing and the sleeve, wherein the first and second primary sensors are disposed at different circumferential positions around the longitudinal axis, wherein the method includes:

detecting a marker with each of the first and second primary sensors;

producing an output signal by processing signal components of each of the first and second primary sensors; and correcting for concentric misalignment between the sleeve and the housing.

22. The method of claim 21, including processing output signal components from each of the first and second primary sensors by one or more of combining, integrating, summing and subtracting said output signal components.

23. The method of claim 21, including processing an output signal from at least one reference sensor.

24. The method of claim 23, wherein the reference sensor(s) provide a signal indicating the distance between the sleeve and the housing at an un-marked portion of the assembly when the primary sensors detect a marker.

25. The method of claim 23, including processing the signal(s) from the reference sensor(s) along with the signals from the primary sensors to provide a reference signal reflecting a baseline signal in the absence of a marker.

26. The method of claim 21, including processing an output signal from first and second reference sensors wherein the first and second reference sensors are circumferentially spaced around the longitudinal axis.

27. A downhole valve assembly, comprising:

a housing with a longitudinal axis and a sleeve concentric with the housing and that is movable relative to a flowpath through the housing to vary flow of fluid through the flowpath in different relative positions of the housing and the sleeve, wherein the valve assembly incorporates a sensor assembly providing an output signal indicating the position of the sleeve relative to the housing, wherein the sensor assembly comprises:

first and second primary sensors disposed on one of the housing and the sleeve adapted to detect markers on the other of the housing and the sleeve, wherein the first and second primary sensors are disposed in diagonally opposite circumferential positions around the longitudinal axis, and wherein the output signal is produced by processing signal components of each of the first and second primary sensors to correct for concentric misalignment between the sleeve and the housing, and wherein the first and second primary sensors comprise inductive proximity sensors.

* * * * *